US011830470B2

(12) United States Patent
Kodatsu et al.

(10) Patent No.: US 11,830,470 B2
(45) Date of Patent: Nov. 28, 2023

(54) TRANSFER FUNCTION MEASURING METHOD AND ACTIVE NOISE REDUCTION DEVICE

(71) Applicant: PANASONIC INTELLECTUAL PROPERTY MANAGEMENT CO., LTD., Osaka (JP)

(72) Inventors: Taiki Kodatsu, Osaka (JP); Yoshiyuki Hayashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 109 days.

(21) Appl. No.: 17/706,047

(22) Filed: Mar. 28, 2022

(65) Prior Publication Data

US 2022/0343891 A1 Oct. 27, 2022

(30) Foreign Application Priority Data

Mar. 31, 2021 (JP) ..... 2021-059996

(51) Int. Cl.
*G10K 11/178* (2006.01)

(52) U.S. Cl.
CPC .. *G10K 11/17881* (2018.01); *G10K 11/17854* (2018.01); *G10K 11/17883* (2018.01)

(58) Field of Classification Search
CPC ..... G10K 11/1781; G10K 11/17813; G10K 11/17815; G10K 11/17821; G10K 11/17823; G10K 2210/3021; G10K 2210/3023; G10K 2210/30232; G10K 2210/3025; G10K 2210/3055
See application file for complete search history.

(56) References Cited

U.S. PATENT DOCUMENTS

2008/0152158 A1* 6/2008 Sakamoto ..... G10K 11/17823 381/71.4
2019/0266994 A1* 8/2019 Inoue ..... G10K 11/1785

FOREIGN PATENT DOCUMENTS

EP 1906384 A1 * 4/2008 ..... G10K 11/1784
JP 7-162986 6/1995
JP 2008-247279 10/2008
JP 2009057018 A * 3/2009 ..... G10K 11/178

* cited by examiner

*Primary Examiner* — Kile O Blair
(74) *Attorney, Agent, or Firm* — GREENBLUM & BERNSTEIN, P.L.C.

(57) ABSTRACT

A transfer function measuring method includes: outputting a first signal to each of a plurality of loudspeakers to cause the plurality of loudspeakers to simultaneously output sounds with mutually different frequencies; acquiring second signals output from a microphone as a result of acquiring the sounds with the mutually different frequencies; and calculating a transfer function of each of the sounds with the mutually different frequencies based on the first signal and the second signals.

10 Claims, 15 Drawing Sheets

TRANSFER FUNCTION MEASURING METHOD AND ACTIVE NOISE REDUCTION DEVICE

CROSS REFERENCE TO RELATED APPLICATION

The present application is based on and claims priority of Japanese Patent Application No. 2021-059996 filed on Mar. 31, 2021.

FIELD

The present disclosure relates to a transfer function measuring method and an active noise reduction device.

BACKGROUND

Conventionally, an active noise reduction device is known that actively reduces noise by outputting a cancelling sound for cancelling out the noise from a loudspeaker by using a reference signal that has a correlation with the noise and an error signal that is based on a residual sound generated through the interference between the noise and the cancelling sound in a predetermined space (see, for example, Patent Literature (PTL) 1). The active noise reduction device generates a cancelling signal for outputting the cancelling sound by using an adaptive filter so as to minimize the sum of squares of the error signal.

CITATION LIST

Patent Literature

PTL 1: Japanese Unexamined Patent Application Publication No. H07-162986

SUMMARY

The present disclosure provides a transfer function measuring method capable of improving upon the above related art.

Solution to Problem

A transfer function measuring method according to one aspect of the present disclosure includes: outputting a first signal to each of a plurality of loudspeakers to cause the plurality of loudspeakers to simultaneously output sounds with mutually different frequencies; acquiring second signals output from a microphone as a result of acquiring the sounds with the mutually different frequencies; and calculating a transfer function of each of the sounds with the mutually different frequencies based on the first signal and the second signals.

The transfer function measuring method according to one aspect of the present disclosure is capable of improving upon the above related art.

BRIEF DESCRIPTION OF DRAWINGS

These and other advantages and features of the present disclosure will become apparent from the following description thereof taken in conjunction with the accompanying drawings that illustrate a specific embodiment of the present disclosure.

DESCRIPTION OF EMBODIMENT

Figure 1:
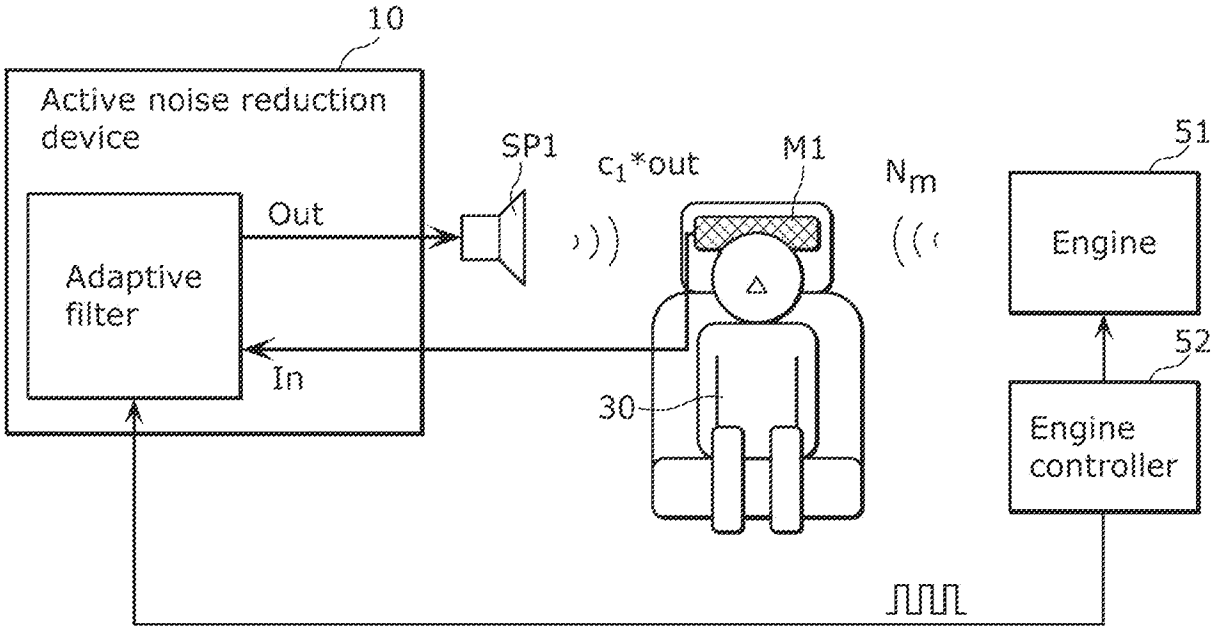
FIG. 1 is a diagram showing an overview of a noise reduction device according to an embodiment.

Hereinafter, an embodiment will be described specifically with reference to the drawings. The embodiment described below shows a generic or specific example of the present disclosure. The numerical values, shapes, materials, structural elements, the arrangement and connection of the structural elements, steps, the order of the steps, and the like shown in the following embodiment are merely examples, and therefore are not intended to limit the scope of the present disclosure.

Also, among the structural elements described in the embodiment given below, structural elements not recited in any one of the independent claims are described as arbitrary structural elements.

Also, the diagrams are schematic representations, and thus are not necessarily true to scale. Also, in the diagrams, structural elements that are substantially the same are given the same reference numerals, and a redundant description may be omitted or simplified.

Embodiment

[Overview]

First, an overview of an active noise reduction device according to an embodiment will be described. First, FIG. 1 is a diagram showing the overview of the active noise reduction device according to the embodiment.

Active noise reduction device 10 shown in FIG. 1 is, for example, a device that is installed in a cabin of an automobile, and reduces noise generated in the automobile while the automobile is driving. The noise caused by engine 51 is a sound that is instantaneously close to a single frequency sine wave. Accordingly, active noise reduction device 10 acquires a pulse signal indicating the frequency of engine 51 from engine controller 52 that controls engine 51, and outputs a cancelling sound for cancelling out the noise from loudspeaker SP1. For the generation of the cancelling sound, an adaptive filter is used, and the cancelling sound is generated such that a residual sound acquired by microphone M1 disposed in the vicinity of hearer 30 is reduced.

As shown in FIG. 1, a transfer function from the position of loudspeaker SP1 (hereinafter also referred to as "sound output position") to the position of microphone M1 (hereinafter also referred to as sound recording position) is expressed by the sign "$c_1$", and an output signal for outputting a cancelling sound is expressed by the sign "out". In this case, the cancelling sound that reaches the position of microphone M1 (sound recording position) is expressed by the sign "$c_1$*out". Here, the sign "*" indicates a convolutional operator, the sign "$c_1$" indicates an impulse response of the transfer function, and the sign "$C_1$" indicates a simulated transfer function in a frequency domain.

Noise $N_m$ at the position of microphone M1 is expressed by Equation 1 given below, where the amplitude is represented by R, the angular frequency is represented by w, and the phase is represented by θ, and the sign "$c_1$*out" is expressed by Equation 2-1 and Equation 2-2 given below. Active noise reduction device 10 can output a cancelling sound for cancelling out the noise by calculating first filter coefficient A and second filter coefficient B in Equation 2-1 and Equation 2-2 by using, for example, an LMS (Least Mean Square) method.

[Math. 1]

$$N_m = R\cdot\sin(\omega t+\theta) \quad \text{(Equation 1)}$$

$$c_1\text{*out} = R\cdot\sin[\omega t+(\theta-\pi)]$$

When $c_1=1$, $$c_1\text{*out} = R\cdot\sin[\omega t+(\theta-\pi)] = A\cdot\sin(\omega t)+B\cdot\cos(\omega t)$$

Where $$R=\sqrt{A^2+B^2},\ \theta-\pi=\tan^{-1}(B|A) \quad \text{(Equation 2-1)}$$

When $c_1\neq 1$, $$c_1\text{*out} = R\cdot\sin[\omega t+(\theta-\pi)] = A'\cdot\sin(\omega t)+B'\cdot\cos(\omega t)$$

$$R=\sqrt{A'^2+B'^2},\ \theta-\pi=\tan^{-1}(B'|A'), \quad \text{(Equation 2-2)}$$

Where $$A'+jB'=c_1(\omega)(A+jB)$$

Figure 2:
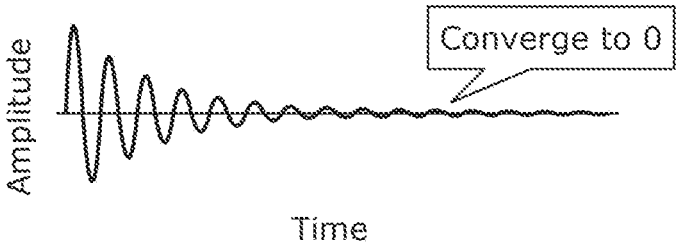
FIG. 2 is a schematic diagram showing a temporal waveform of noise heard at a position of a microphone.

As described above, as a result of a cancelling sound with an opposite phase to that of noise $N_m$ being output, as shown in FIG. 2, the noise heard at the position of microphone M1 is reduced. FIG. 2 is a schematic diagram showing a temporal waveform of the noise heard at the position of microphone M1.

[Overall Configuration of Automobile Including Active Noise Reduction Device]

Figure 3:
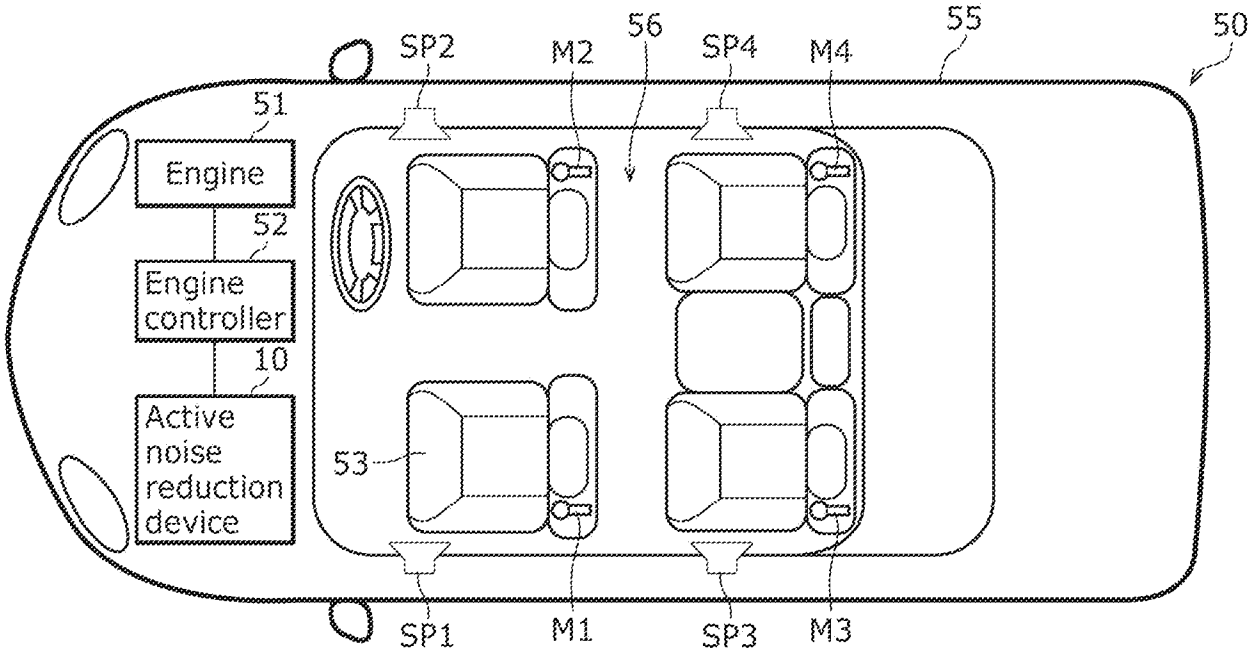
FIG. 3 is a schematic diagram of an automobile that includes the noise reduction device according to the embodiment.

Hereinafter, a detailed description of active noise reduction device 10 configured as described above will be given. In the embodiment, active noise reduction device 10 is incorporated in, for example, an automobile. FIG. 3 is a schematic diagram of an automobile that includes active noise reduction device 10.

Automobile 50 is an example of a vehicle, and includes active noise reduction device 10, engine 51, engine controller 52, loudspeakers SP1 to SP4, microphones M1 to M4, and automobile main body 55. Automobile 50 is specifically a passenger car, but the present disclosure is not limited thereto.

Engine 51 is a driving device that serves as a power source of automobile 50 and also as a noise source that produces noise in predetermined space 56. Engine 51 is disposed in, for example, a space different from predetermined space 56. Specifically, engine 51 is disposed in a space formed under the hood of automobile main body 55.

Engine controller 52 controls (drives) engine 51 based on an acceleration operation and the like of the driver of automobile 50. Also, engine controller 52 outputs a pulse signal (engine pulse signal) according to the number of revolutions (frequency) of engine 51 as a reference signal. The frequency of the pulse signal is proportional to, for example, the number of revolutions (frequency) of engine 51. Specifically, the pulse signal is an output signal of a TDC (Top Dead Center) sensor, or a so-called tachopulse, or the like. The reference signal may be in any form as long as the reference signal has a correlation with noise.

Loudspeakers SP1 to SP4 each output a cancelling sound by using a cancelling signal to predetermined space 56. The installation positions of loudspeakers SP1 to SP4 are not particularly limited.

Microphones M1 to M4 each detect a residual sound generated through the interference between the noise and the cancelling sound in predetermined space 56, and output an error signal that is based on the residual sound. Microphones M1 to M4 are installed in, for example, in the headliner above the seats in predetermined space 56 or the like, but the installation positions of microphones M1 to M4 are not particularly limited.

Automobile main body 55 is a structural body that includes a chassis, a body, and the like of automobile 50. Automobile main body 55 forms predetermined space 56 (the space in the automobile cabin) in which loudspeakers SP1 to SP4 and microphones M1 to M4 are disposed.

[Configuration and Basic Operation of Active Noise Reduction Device]

Figure 4:
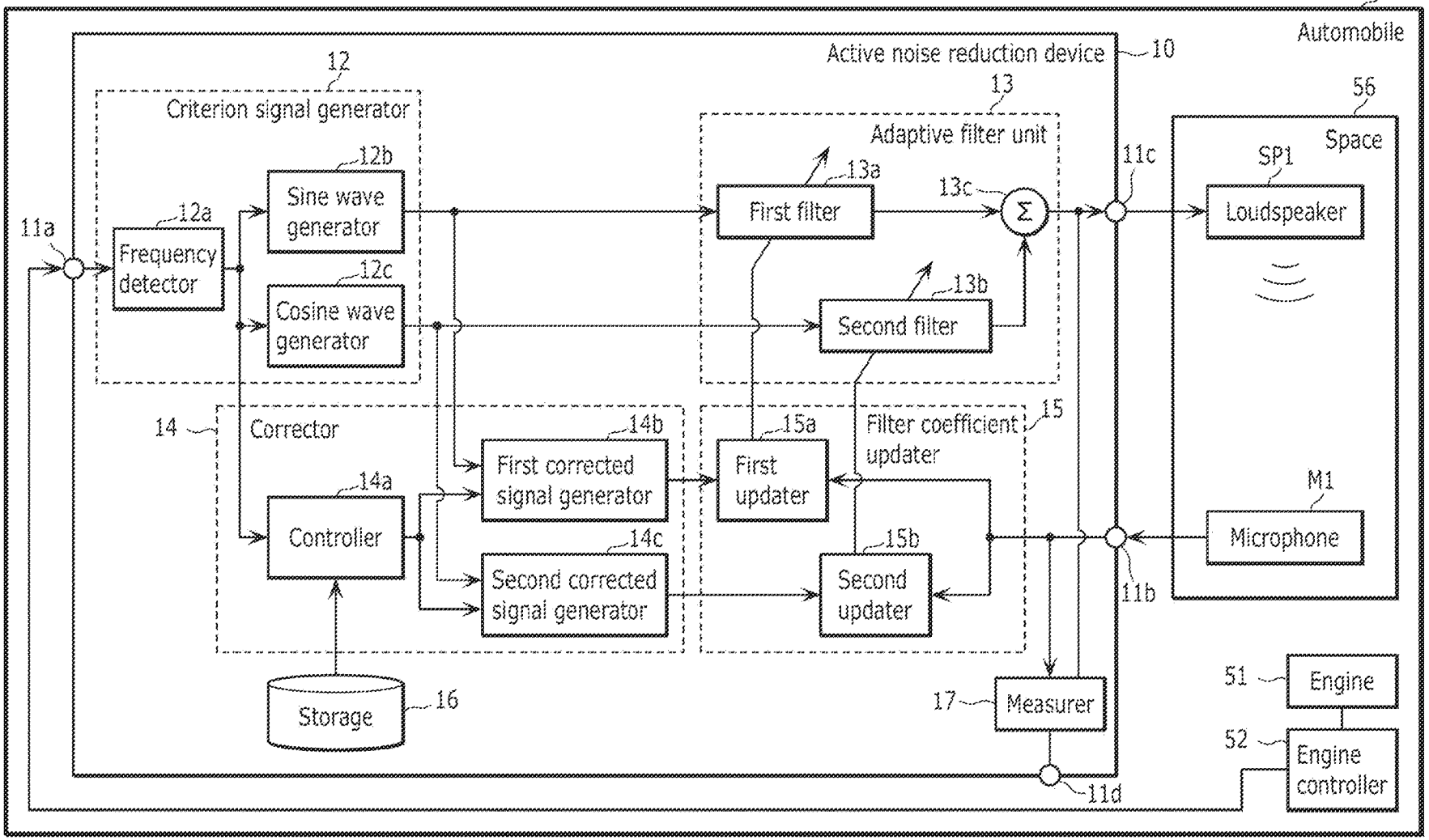
FIG. 4 is a functional block diagram of the noise reduction device according to the embodiment.
Figure 5:
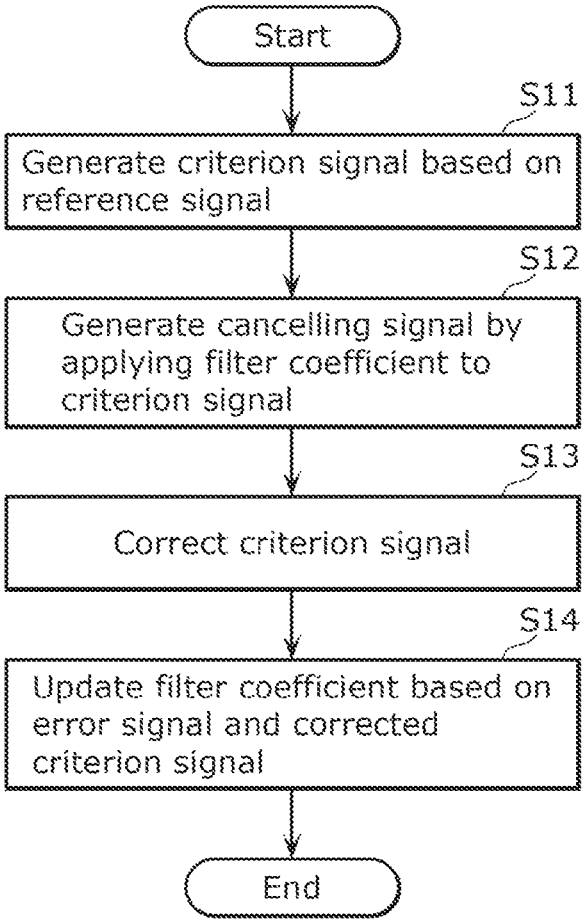
FIG. 5 is a flowchart of a basic operation performed by the noise reduction device according to the embodiment.

Next, a configuration and a basic operation of active noise reduction device 10 will be described. FIG. 4 is a functional block diagram of active noise reduction device 10. FIG. 5 is a flowchart of the basic operation of active noise reduction device 10. For the sake of simplification of the description, hereinafter, an example of an operation for reducing noise at the installation position of microphone M1 by using a cancelling sound output from the installation position of loudspeaker SP1 will be described. Active noise reduction device 10 can also output cancelling sounds from loudspeakers SP1 to SP4 to reduce noise at the installation positions of microphones M1 to M4.

As shown in FIG. 4, active noise reduction device 10 includes reference signal input terminal 11*a*, criterion signal generator 12, adaptive filter unit 13, cancelling signal output terminal 11*c*, corrector 14, error signal input terminal 11*b*, filter coefficient updater 15, storage 16, connection terminal 11*d*, and measurer 17. Each of reference signal generator 12, adaptive filter unit 13, corrector 14, filter coefficient updater 15, and measurer 17 is implemented by, for example, a processor such as a DSP (Digital Signal Processor) or a microcomputer executing a computer program stored in storage 16. Hereinafter, related structural elements will be described in detail for each step of the flowchart shown in FIG. 5.

[Generation of Criterion Signals]

First, criterion signal generator 12 generates criterion signals based on a reference signal input to reference signal input terminal 11*a* (S11 in FIG. 5).

A reference signal that has a correlation with noise is input to reference signal input terminal 11*a*. The reference signal is, for example, a pulse signal output by engine controller 52.

More specifically, criterion signal generator 12 identifies an instantaneous frequency of noise based on the reference signal input to reference signal input terminal 11*a*, and generates criterion signals that have the identified frequency. Reference signal generator 12 specifically includes frequency detector 12*a*, sine wave generator 12*b*, and cosine wave generator 12*c*.

Frequency detector 12*a* detects the frequency of the pulse signal, and outputs the detected frequency to sine wave generator 12*b* and cosine wave generator 12*c*. In other words, frequency detector 12*a* identifies an instantaneous frequency of noise.

Sine wave generator 12*b* outputs, as a first criterion signal, the sine wave of the frequency detected by frequency detector 12*a*. The first criterion signal is an example of a criterion signal, and is expressed by $\sin(2\pi ft)=\sin(\omega t)$, where the frequency detected by frequency detector 12*a* is represented by f. That is, the first criterion signal has the frequency identified by frequency detector 12*a* (the same frequency as noise). The first criterion signal is output to first filter 13*a* of adaptive filter unit 13 and first corrected signal generator 14*b* of corrector 14.

Cosine wave generator 12*c* outputs, as a second criterion signal, the cosine wave of the frequency detected by frequency detector 12*a*. The second criterion signal is an example of a criterion signal, and is expressed by $\cos(2\pi ft)=\cos(\omega t)$, where the frequency detected by frequency detector 12*a* is represented by f. That is, the second criterion signal has the frequency identified by frequency detector 12*a* (the same frequency as noise). The second criterion signal is output to second filter 13*b* of adaptive filter unit 13 and second corrected signal generator 14*c* of corrector 14.

[Generation of Cancelling Signal]

Adaptive filter unit 13 generates a cancelling signal by applying (multiplying) filter coefficients to the criterion signals generated by criterion signal generator 12 (S12 in FIG. 5). In other words, adaptive filter unit 13 applies filter coefficients to the reference signal that was input to reference signal input terminal 11*a* and converted to the criterion signals. The cancelling signal is used to output a cancelling sound for noise reduction, and output to cancelling signal output terminal 11*c*. Adaptive filter unit 13 includes first filter 13*a*, second filter 13*b*, and adder 13*c*. Adaptive filter unit 13 is a so-called adaptive notch filter.

First filter 13*a* multiplies the first criterion signal output from sine wave generator 12*b* by a first filter coefficient. The first filter coefficient to be multiplied is a filter coefficient that corresponds to A in Equation 2 given above, and is sequentially updated by first updater 15*a* of filter coefficient updater 15. A first cancelling signal that is the first criterion signal multiplied by the first filter coefficient is output to adder 13*c*.

Second filter 13*b* multiplies the second criterion signal output from cosine wave generator 12*c* by a second filter coefficient. The second filter coefficient to be multiplied is a filter coefficient that corresponds to B in Equation 2 given above, and is sequentially updated by second updater 15*b* of filter coefficient updater 15. A second cancelling signal that is the second criterion signal multiplied by the second filter coefficient is output to adder 13*c*.

Adder 13*c* adds the first cancelling signal output from first filter 13*a* and the second cancelling signal output from second filter 13*b*. Adder 13*c* outputs a cancelling signal obtained by adding the first cancelling signal and the second cancelling signal to cancelling signal output terminal 11*c*.

Cancelling signal output terminal 11*c* is a terminal made of a metal or the like. The cancelling signal generated by adaptive filter unit 13 is output to cancelling signal output terminal 11*c*. Cancelling signal output terminal 11*c* is connected to loudspeaker SP1. Accordingly, the cancelling signal is output to loudspeaker SP1 via cancelling signal output terminal 11*c*. Loudspeaker SP1 outputs a cancelling sound based on the cancelling signal.

[Correction of Criterion Signals]

Corrector 14 generates corrected criterion signals obtained by applying simulated transfer functions to the criterion signals. That is, corrector 14 generates corrected criterion signals by correcting the criterion signals (S13 in FIG. 5). Corrector 14 includes controller 14*a*, first corrected signal generator 14*b*, and second corrected signal generator 14*c*.

Each of the simulated transfer functions is a transfer function obtained by simulating a path from the position of loudspeaker SP1 to the position of microphone M1. The simulated transfer function specifically includes a gain and a phase (phase delay) for each frequency. The simulated transfer function is measured in, for example, space 56 for each frequency, and stored in storage 16 in advance. That is, frequencies, and gains and phases used to correct signals of the frequencies are stored in storage 16.

Controller 14*a* acquires the frequency output by frequency detector 12*a*, and reads a gain and a phase that correspond to the acquired frequency from storage 16. Then, controller 14*a* outputs the gain and the phase that have been read.

First corrected signal generator 14*b* generates a first corrected criterion signal by correcting the first criterion signal based on the gain and the phase output by controller 14*a*. The first corrected criterion signal is an example of a corrected criterion signal. The first corrected criterion signal is expressed by $\alpha\cdot\sin(\omega t+\varphi\alpha)$, where the gain and the corrected phase output by controller 14*a* are represented by a and $\varphi\alpha$, respectively. The generated first corrected criterion signal is output to first updater 15*a* of filter coefficient updater 15.

Second corrected signal generator 14*c* generates a second corrected criterion signal by correcting the second criterion signal based on the gain and the phase output by controller 14*a*. The second corrected criterion signal is an example of a corrected criterion signal. The second corrected criterion signal is expressed by $\beta \cdot \cos(\omega t+\varphi\beta)$, where the gain and the corrected phase output by controller 14*a* are represented by $\beta$ and $\varphi\beta$, respectively. The generated second corrected criterion signal is output to second updater 15*b* of filter coefficient updater 15.

Storage 16 is a storage device that stores the simulated transfer functions. Storage 16 also stores the adaptive filter coefficients, and the like. Specifically, storage 16 is implemented by using a semiconductor memory or the like. In the case where active noise reduction device 10 is implemented by using a processor such as a DSP, a control program that is executed by the processor is also stored in storage 16. Storage 16 may also store other parameters that are used in signal processing operations performed by active noise reduction device 10.

[Update of Filter Coefficients]

Filter coefficient updater 15 sequentially updates the filter coefficients based on the error signal input to error signal input terminal 11*b* and the generated corrected criterion signals (S14 in FIG. 5).

Error signal input terminal 11*b* is a terminal made of a metal or the like. Error signal input terminal 11*b* receives an input of an error signal that is based on a residual sound generated at a second position of microphone M1 through the interference between the cancelling sound and the noise. The error signal is output by microphone M1.

Filter coefficient updater 15 specifically includes first updater 15*a* and second updater 15*b*.

First updater 15*a* calculates a first filter coefficient based on the first corrected criterion signal acquired from first corrected signal generator 14*b* and the error signal acquired from microphone M1. Specifically, first updater 15*a* calculates the first filter coefficient by using an LMS method so as to minimize the error signal, and outputs the calculated first filter coefficient to first filter 13*a*. Also, first updater 15*a* sequentially updates the first filter coefficient. First filter coefficient A (corresponding to A in Equation 2 given above) is expressed by Equation 3 given below, where the first corrected criterion signal is represented by $r_1$, and the error signal is represented by e. Here, n is a natural number, and is a variable that indicates the n-th update (or in other words, a variable that indicates the number of updates performed). That is, A(n) indicates a state when the n-th update has been performed. $\mu$ is a scalar quantity, and is a step size parameter for determining the update amount of the filter coefficient per sample.

[Math. 2]

$$A(n)=A(n-1)-\mu \cdot r_1(n) \cdot e(n) \quad \text{(Equation 3)}$$

Second updater 15*b* calculates a second filter coefficient based on the second corrected criterion signal acquired from second corrected signal generator 14*c* and the error signal acquired from microphone M1. Specifically, second updater 15*b* calculates the second filter coefficient by using an LMS method so as to minimize the error signal, and outputs the calculated second filter coefficient to second filter 13*b*. Also, second updater 15*b* sequentially updates the second filter coefficient. Second filter coefficient B (corresponding to B in Equation 2 given above) is expressed by Equation 4 given below, where the second corrected criterion signal is represented by $r_2$, and the error signal is represented by e.

[Math. 3]

$$B(n)=B(n-1),\mu \cdot r_2(n) \cdot e(n) \quad \text{(Equation 4)}$$

[Transfer Function Measuring Method]

Figure 6:
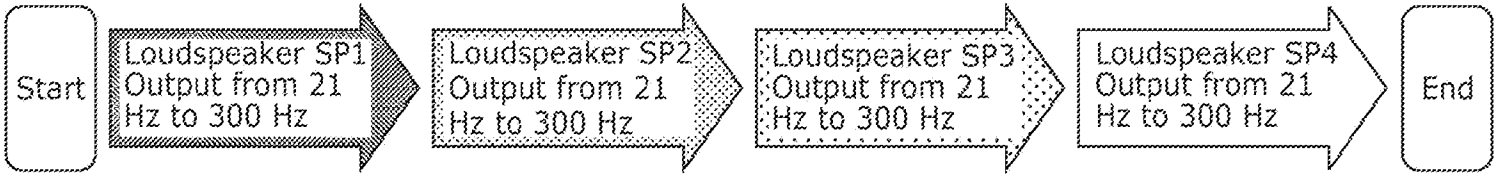
FIG. 6 is a diagram showing an overall procedure of a transfer function measuring method according to a comparative example.

As described above, the simulated transfer functions (hereinafter also referred to simply as "transfer functions") measured in advance are stored in storage 16 of active noise reduction device 10. Here, for measuring transfer functions in space 56 where four loudspeakers SP1 to SP4 and four microphones M1 to M4 have been installed, a measuring method may be used in which an operation of acquiring a sound output from one loudspeaker (more specifically, a sound of a single frequency, sine wave) by four microphones M1 to M4 is repeated a number of times equal to the number of loudspeakers SP1 to SP4, specifically, four times. That is, a method may be used in which transfer functions are measured by limiting the number of loudspeakers that simultaneously output sounds to one. FIG. 6 is a diagram showing an overall procedure of a transfer function measuring method according to a comparative example as described above. In the example shown in FIG. 6, the sound that is output from each loudspeaker varies by 1 Hz in a range of 21 to 300 Hz. That is, transfer functions (gains and phases) are measured for every 1 Hz.

Figure 7:
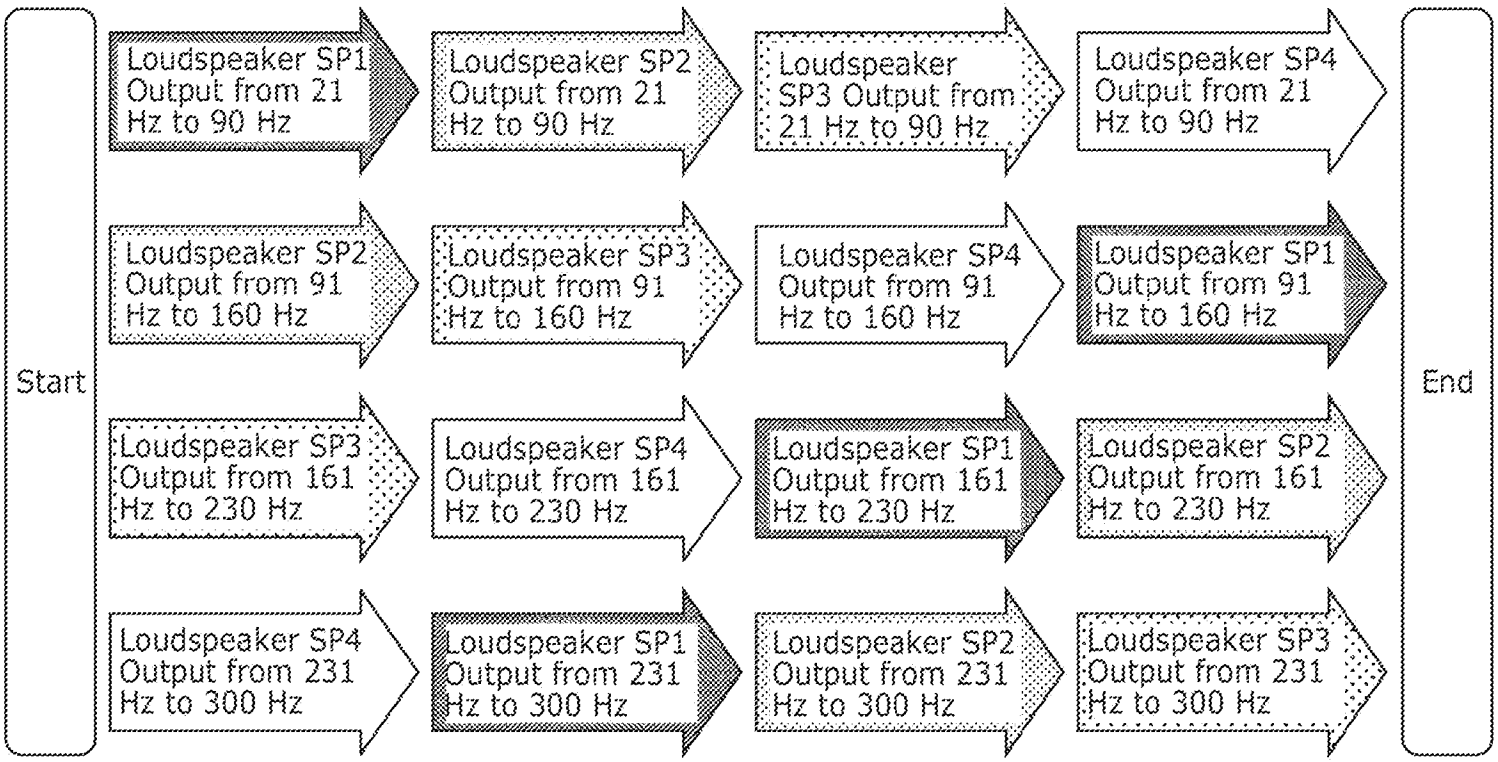
FIG. 7 is a diagram showing an overall procedure of a transfer function measuring method according to an embodiment.
Figure 8:
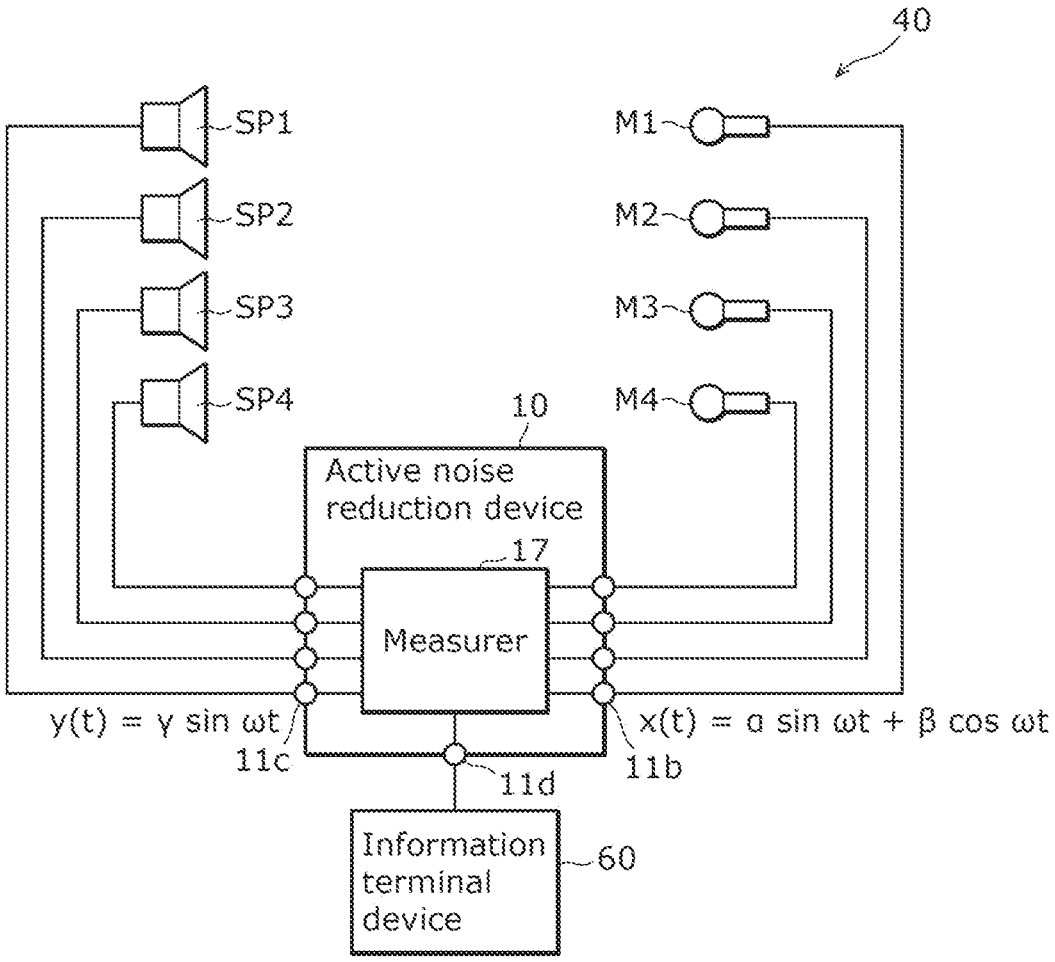
FIG. 8 is a block diagram showing a functional configuration of a transfer function measuring system according to an embodiment.

The measuring method shown in FIG. 6 is problematic in that it takes a large amount of time to perform transfer function measurement. To address this, the inventors of the present application conducted in-depth studies, and as a result, they found a measuring method as shown in FIG. 7 in which loudspeakers SP1 to SP4 are caused to simultaneously (or in other words, in parallel) output sounds with mutually different frequencies. FIG. 7 is a diagram showing an overall procedure of a transfer function measuring method according to the embodiment. This measuring method is the same as that of the comparative example in that transfer functions (gains and phases) are measured for every 1 Hz. Hereinafter, the measuring method shown in FIG. 7 will be specifically described. FIG. 8 is a block diagram showing a functional configuration of a transfer function measuring system according to the embodiment.

Measuring system 40 shown in FIG. 8 includes active noise reduction device 10, loudspeakers SP1 to SP4, microphones M1 to M4, and information terminal device 60. Active noise reduction device 10 has a measurement mode (an example of a second operation mode) for executing the transfer function measuring method of the embodiment shown in FIG. 7, in addition to a normal operation mode (an example of a first operation mode) for performing the operation as shown in FIG. 5 (or in other words, for reducing noise in space 56). In the measurement mode, processing is performed mainly by measurer 17.

Information terminal device 60 is an information terminal device that functions as a user interface in the measurement mode, and is connected to connection terminal 11*d* of active noise reduction device 10 via a cable or the like. Information terminal device 60 is, for example, a personal computer or the like. Measuring system 40 does not necessarily need to include information terminal device 60, and the transfer function measurement may be performed by using active noise reduction device 10 alone without using information terminal device 60.

Figure 9:
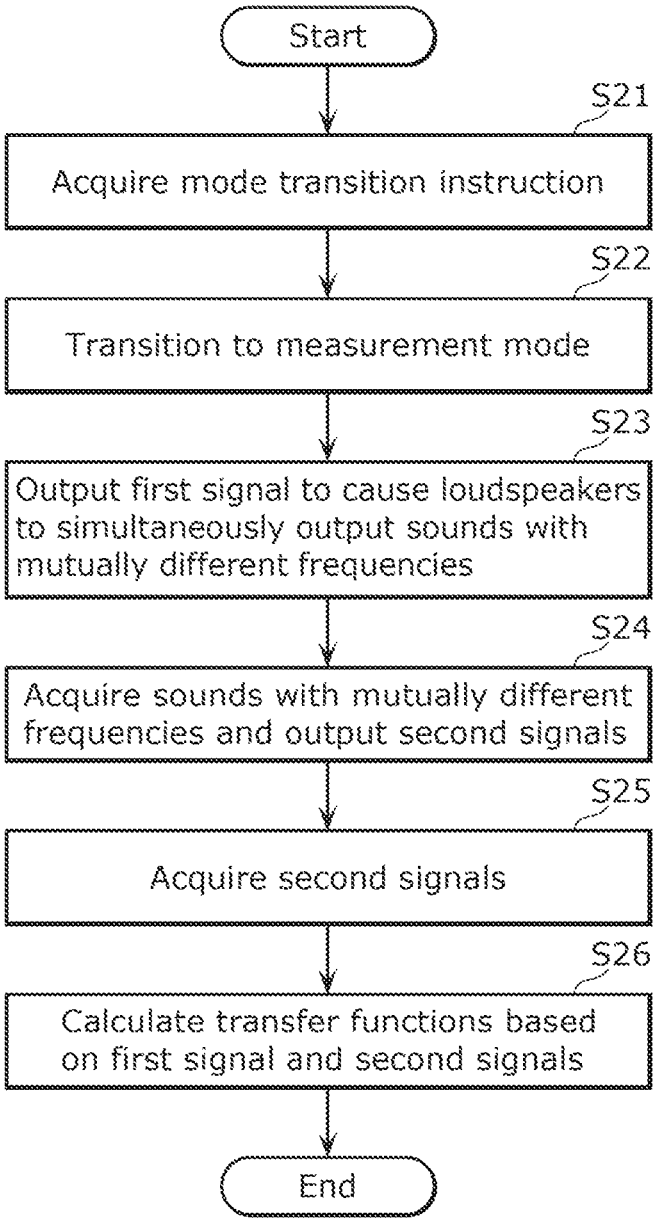
FIG. 9 is a flowchart of the transfer function measuring method according to the embodiment.

FIG. 9 is a flowchart of the transfer function measuring method according to the embodiment. Here, mathematical equations used in the following description of the transfer function measuring method are consecutive mathematical equations, but measurer 17 may actually perform processing based on discrete mathematical equations that approximate consecutive mathematical equations. First, active noise reduction device 10 (measurer 17) acquires a mode transition instruction output by information terminal device 60 via connection terminal 11*d* (S21). Active noise reduction device 10 transitions to the measurement mode based on the acquired mode transition instruction (S22).

During operation in the measurement mode, measurer 17 outputs a first signal to each of loudspeakers SP1 to SP4 so as to cause loudspeakers SP1 to SP4 to simultaneously output sounds with mutually different frequencies (sine waves) (S23). For example, as shown in FIG. 7 mentioned above, when loudspeaker SP1 outputs a sound with a frequency of 21 Hz, loudspeaker SP2 outputs a sound with a frequency of 91 Hz, loudspeaker SP3 outputs a sound with a frequency of 161 Hz, and loudspeaker SP4 outputs a sound with a frequency of 231 Hz. When loudspeaker SP1 outputs a sound with a frequency of 22 Hz, loudspeaker SP2 outputs a sound with a frequency of 92 Hz, loudspeaker SP3 outputs a sound with a frequency of 162 Hz, and loudspeaker SP4 outputs a sound with a frequency of 232 Hz. In the case where the frequencies that are measured simultaneously are close to each other, it is highly likely that the measurement results are affected by interference. For this reason, the difference between frequencies that are measured simultaneously is set to, for example, 30 Hz or more.

Microphones M1 to M4 simultaneously acquire sounds with mutually different frequencies, and output second signals as a result of acquiring the sounds with mutually different frequencies (S24). Measurer 17 acquires the second signals output from microphones M1 to M4 (S25).

Next, measurer 17 calculates transfer functions based on the first signal output in step S23 and the second signals acquired in step S25 (S26). For example, measurer 17 can calculate a transfer function from the position of loudspeaker SP1 to the position of microphone M1 based on the first signal output to loudspeaker SP1 and the second signal acquired from microphone M1. Hereinafter, the transfer function calculation method performed in step S26 will be described specifically.

The transfer function gain and phase can be determined based on equations given below, where the first signal output to loudspeaker SP1 is represented by y(t)=y sin ωt, and the second signal acquired from microphone M1 is represented by x (t)=α sin ωt+β cos ωt. a tan 2 indicates an arc tangent that takes two arguments.

[Math. 4]

$$|G(j\omega)| = \sqrt{\frac{\alpha^2+\beta^2}{\gamma^2}}$$

$$\angle G(j\omega) = \begin{cases} a\tan2(\beta, \alpha), & \alpha \neq 0 \text{ or } \beta \neq 0 \\ 0, & \alpha = 0 \text{ and } \beta = 0 \end{cases}$$

$$a\tan2(y, x) = \begin{cases} \arctan\left(\frac{y}{x}\right) & , x > 0 \\ \arctan\left(\frac{y}{x}\right) + \pi & , x < 0 \text{ and } y \geq 0 \\ \arctan\left(\frac{y}{x}\right) - \pi & , x < 0 \text{ and } y < 0 \\ +\frac{\pi}{2} & , x = 0 \text{ and } y > 0 \\ -\frac{\pi}{2} & , x = 0 \text{ and } y < 0 \\ \text{undefined} & , x = 0 \text{ and } y = 0 \end{cases}$$

In order to calculate the transfer function gain and phase, at a frequency, measurer 17 calculates parameters A and B, and C shown below based on time $T_m$ (hereinafter also referred to as "measurement time $T_m$") required to measure the transfer function from loudspeaker SP1 to microphone M1, first signal y (t), and second signal x (t).

[Math. 5]

$$A=\int_0^{T_m} x(t)\times\sin\omega t\, dt$$

$$B=\int_0^{T_m} x(t)\times\cos\omega t\, dt$$

$$C=\int_0^{T_m} y(t)\times\sin\omega t\, dt$$

y (t)× sin ωt is an example of a first function that is based on first signal y (t) and uses time as a variable. Parameter C is an example of a first parameter obtained by time-integrating the first function. x (t)× sin ωt and x (t)× cos ωt are examples of second functions that are based on second signal x (t) and use time as a variable. Parameter A and parameter B are examples of second parameters obtained by time-integrating the second functions. Measurement time $t_m$ represents the time corresponding to an integration interval. Parameters A, B, and C are developed as follows.

[Math. 6]

$$\begin{aligned} A &= \int_0^{T_m} x(t)\times\sin\omega t\, dt \\ &= \int_0^{T_m} (\alpha\sin\omega t + \beta\cos\omega t)\times\sin\omega t\, dt \\ &= \int_0^{T_m} (\alpha\sin^2\omega t + \beta\sin\omega t\cos\omega t)\, dt \\ &= \frac{1}{2}\int_0^{T_m} (\alpha - \alpha\cos 2\omega t + \beta\sin 2\omega t)\, dt \\ &= \frac{1}{2}\left[\alpha t - \frac{\alpha}{2\omega}\sin 2\omega t - \frac{\beta}{2\omega}\cos 2\omega t\right]_0^{T_m} \\ &= \frac{1}{2}\left(\alpha T_m - \underline{\frac{\alpha}{2\omega}\sin 2\omega T_m - \frac{\beta}{2\omega}(\cos 2\omega T_m - 1)}\right) \\ B &= \int_0^{T_m} x(t)\times\cos\omega t\, dt \\ &= \int_0^{T_m} (\alpha\sin\omega t + \beta\cos\omega t)\times\cos\omega t\, dt \\ &= \frac{1}{2}\left(\beta T_m + \underline{\frac{\beta}{2\omega}\sin 2\omega T_m - \frac{\alpha}{2\omega}(\cos 2\omega T_m - 1)}\right) \\ C &= \int_0^{T_m} y(t)\times\sin\omega t\, dt \\ &= \frac{1}{2}\left(\gamma T_m - \underline{\frac{\gamma}{2\omega}\sin 2\omega T_m}\right) \end{aligned}$$

As indicated by parameters A and B, and C that have been developed, if $T_m=(n/\omega)\pi$, where n is an arbitrary positive integer (a natural number), the following can be obtained.

[Math. 7]

$$A = \frac{1}{2}\alpha T_m \quad B = \frac{1}{2}\beta T_m \quad C = \frac{1}{2}\gamma T_m$$

The transfer function gain and phase described above can be expressed as follows by using parameters A and B, and C.

[Math. 8]

$$|G(j\omega)| = \sqrt{\frac{\alpha^2+\beta^2}{\gamma^2}} = \sqrt{\frac{A^2+B^2}{C^2}}$$

$$\angle G(j\omega) = \begin{cases} a\tan2(\beta, \alpha) = a\tan2(B, A), & \alpha \neq 0 \text{ or } \beta \neq 0 \\ 0, & \alpha = 0 \text{ and } \beta = 0 \end{cases}$$

That is, measurer 17 can calculate the transfer function based on parameters A and B, and C by setting $T_m=(n/\omega)\pi$.

Figure 10:
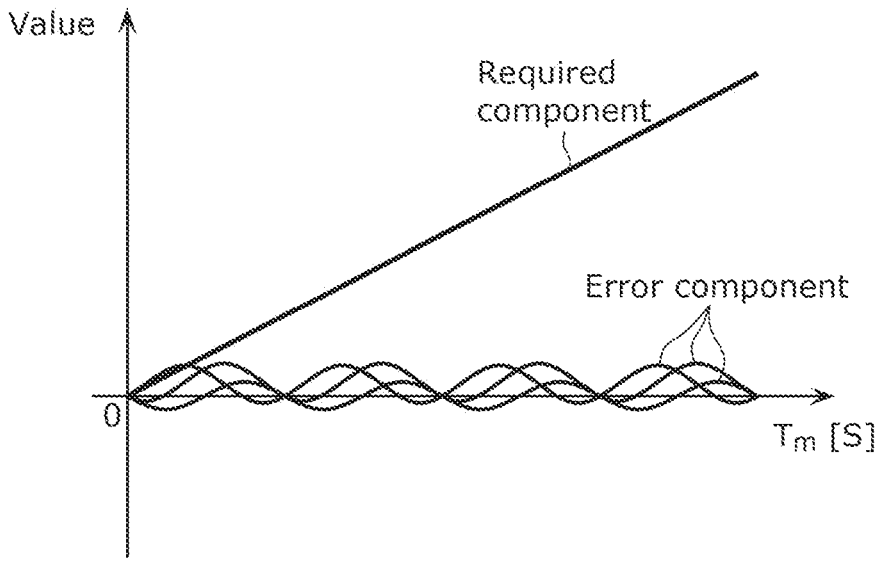
FIG. 10 is a first diagram showing an example of a relationship between a value of a required component, values of error components, and a measurement time.

If $T_m\neq(n/\omega)\pi$, in parameters A and B, and C that have been developed, portions underlined by dotted lines remain as error components. Here, the value of a required component that is required to perform transfer function calculation (term $\alpha T_m$ in parameter A, term $\beta T_m$ in parameter B, or parameter $\gamma T_m$ in parameter C) increases in proportion to $T_m$, but the values of the error components vary periodically. FIG. 10 is a diagram showing an example of a relationship between the value of the required component, the values of error components, and measurement time $T_m$. In FIG. 10, variations in the required component and the error components in the case where $\alpha=\beta=\gamma=1$, and $\omega=200\pi$(100 Hz) are graphed.

As shown in FIG. 10, measurer 17 can reduce the degree of influence of the error components by setting $T_m$ to a sufficiently long time, instead of setting $T_m=(n/\omega)\pi$. In other words, measurer 17 can also reduce the degree of influence of the error components by setting $T_m$ to a sufficiently long time, instead of setting $T_m=(n/\omega)\pi$. As used herein, the term "sufficiently long time" may be, for example, 500 ms, but is not specifically limited thereto.

As described above, measurer 17 of active noise reduction device 10 executes the transfer function measuring method according to the embodiment as shown in FIG. 7. Specifically, measurer 17 outputs a first signal to each of the plurality of loudspeakers SP1 to SP4 so as to cause the plurality of loudspeakers SP1 to SP4 to simultaneously output sounds with mutually different frequencies, and, acquires second signals output from microphone M1 as a result of acquiring the sounds with mutually different frequencies, and calculates a transfer function of each of the sounds with mutually different frequencies based on the first signal and the second signals. With the transfer function measuring method as described above, processing operations can be performed in parallel, and thus the total measurement time can be shortened as compared with the transfer function measuring method of the comparative example as shown in FIG. 6.

When the transfer functions from loudspeakers SP1 to SP4 to microphones M1 to M4 at 21 Hz to 300 Hz (that is, all transfer functions) have been measured, measurer 17 transmits the measurement results to information terminal device 60. As a result, sixteen transfer functions from four loudspeakers SP1 to SP4 to four microphones M1 to M4, each including data obtained at 21 Hz to 300 Hz, are stored in information terminal device 60. Practically, the transfer functions are measured a plurality of times by changing the conditions of automobile 50 (the temperature of space 56, when the windows of automobile 50 are open and closed, and the like), and the final simulated transfer functions are determined. The determined final simulated transfer functions are stored in the storage of the active noise reduction device (a mass-produced item) during the production process.

[Modification 1 to Transfer Function Measuring Method]

When measurement time $t_m$ is set to a sufficiently long time (for example, 500 ms or the like), there may be no significant difference between a transfer function obtained by using the method according to the comparative example (FIG. 6) and a transfer function obtained by using the method according to the embodiment (FIG. 7). Here, in order to further shorten the total measurement time, the inventors of the present application conducted comparison between a transfer function obtained by using the method according to the comparative example and a transfer function obtained by using the method according to the embodiment, by setting measurement time $T_m$ to 10 cycles of a measurement target frequency.

Figure 11:
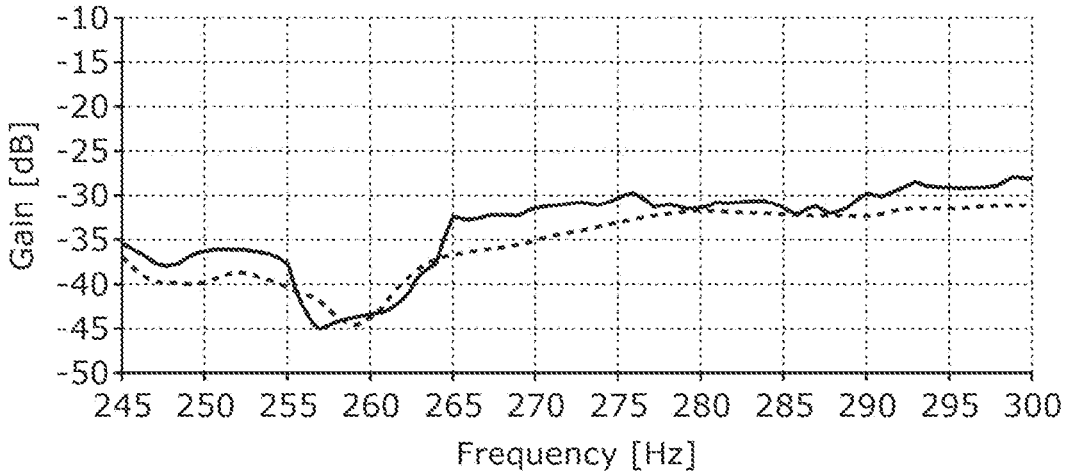
FIG. 11 is a diagram showing transfer function gains obtained by using the measuring method according to the comparative example and the measuring method according to the embodiment, respectively.
Figure 12:
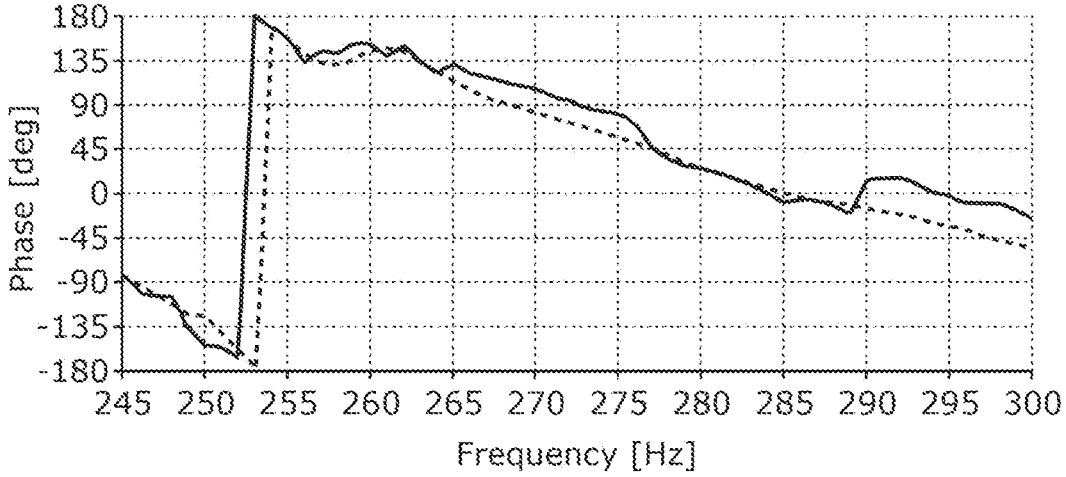
FIG. 12 is a diagram showing transfer function phases obtained by using the measuring method according to the comparative example and the measuring method according to the embodiment, respectively.

FIG. 11 is a diagram showing transfer function gains obtained by using the method according to the comparative example and the method according to the embodiment (comparative example: dotted line, and embodiment: solid line). FIG. 12 is a diagram showing transfer function phases obtained by using the method according to the comparative example and the method according to the embodiment (comparative example: dotted line, and embodiment:

solid line). In the method according to the embodiment, measurement time $t_m$ is set to 10 cycles of the smallest frequency of a plurality of frequencies that simultaneously serve as transfer function measurement targets. For example, in the case where a transfer function at a frequency of 50 Hz and a transfer function at a frequency of 100 Hz are simultaneously measured, 10 cycles of 50 Hz is equal to 200 ms, and 10 cycles of 100 Hz is equal to 100 ms, and thus measurement time $t_m$ is set to 200 ms.

As shown in FIGS. 11 and 12, there is a difference between the transfer function obtained by using the method according to the comparative example and the transfer function obtained by using the method according to the embodiment. Hereinafter, a method for reducing the difference (a method for bringing the transfer function obtained by using the method according to the embodiment close to the transfer function obtained by using the method according to the comparative example) will be described.

In the method according to the embodiment, when measuring a transfer function of a sound with a certain frequency, sounds with other frequencies that are output simultaneously with the sound with a certain frequency serve as disturbance. That is, the second signal contains a disturbance. This disturbance is considered to be the cause of the difference described above. For example, in the case where a transfer function of a sound with angular velocity $\omega_0$ and a transfer function of a sound with angular velocity $\omega_1$ are simultaneously measured by using two loudspeakers, when the sound with angular velocity $\omega_0$ serves as the measurement target, the sound with angular velocity $\omega_1$ serves as a disturbance. When the sound with angular velocity $\omega_1$ serves as the measurement target, the sound with angular velocity $\omega_0$ serves as a disturbance. The second signal that contains a disturbance can be expressed by $x(t)=\alpha \sin \omega t+\beta \cos \omega t+\alpha' \sin \omega' t+\beta' \cos \omega' t$, where the angular velocity that serves as the measurement target is represented by $\omega$, and the angular velocity that serves as a disturbance is represented by $\omega'$. The third term and the fourth term on the right hand side of the equation are disturbance components. Parameters A and B that are based on the second signal out of parameters A, B, and C described above can be expressed as follows.

$$A=\int_0^{T_m} x(t)\times\sin \omega t\, dt=\int_0^{T_m}(\alpha \sin \omega t+\beta \cos \omega t+\alpha' \sin \omega' t+\beta' \cos \omega' t)\times\sin \omega t\, dt$$

$$B=\int_0^{T_m} x(t)\times\cos \omega t\, dt=\int_0^{T_m}(\alpha \sin \omega t+\beta \cos \omega t+\alpha' \sin \omega' t+\beta' \cos \omega' t)\times\cos \omega t\, dt \quad \text{[Math. 9]}$$

Parameter A can be developed as follows.

[Math. 10]

$$\begin{aligned}
A &= \int_0^{T_m}(\alpha\sin\omega t\sin\omega t+\beta\cos\omega t\sin\omega t+\alpha'\sin\omega' t\sin\omega t+\\
&\quad \beta'\cos\omega' t\sin\omega t)dt\\
&= \frac{1}{2}\int_0^{T_m}\{a-\alpha\cos2\omega t+\beta\sin2\omega t-\alpha'\cos(\omega'+\omega)t+\\
&\quad \alpha'\cos(\omega'-\omega)t+\beta'\sin(\omega'+\omega)t-\beta'\sin(\omega'-\omega)t\}dt\\
&= \frac{1}{2}\Big[\alpha t-\frac{\alpha}{2\omega}\sin2\omega t-\frac{\beta}{2\omega}\cos2\omega t-\frac{\alpha'}{\omega'+\omega}\sin(\omega'+\omega)t+\\
&\quad \frac{\alpha'}{\omega'+\omega}\sin(\omega'-\omega)t+\frac{\beta'}{\omega'+\omega}\cos(w'+\omega)t+\\
&\quad \frac{\beta'}{\omega'+\omega}\cos(w'-\omega)t\Big]_0^{T_m}
\end{aligned}$$

-continued $$= \frac{1}{2}\left\{\alpha T_m - \frac{\alpha}{2\omega}\sin 2\omega T_m - \frac{\beta}{2\omega}\cos 2\omega T_m - \frac{\alpha'}{\omega'+\omega}\sin(\omega'+\omega)T_m + \frac{\alpha'}{\omega'-\omega}\sin(\omega'-\omega)T_m - \frac{\beta'}{\omega'+\omega}\cos(\omega'+\omega)T_m + \frac{\beta'}{\omega'-\omega}\cos(\omega'-\omega)T_m + \frac{\beta}{2\omega} + \frac{\beta'}{\omega'+\omega} - \frac{\beta'}{\omega'-\omega}\right.$$

Parameter A can be further rearranged as follows.

[Math. 11]

$$A = \frac{1}{2}[\underbrace{\alpha T_m}_{\text{Required component}} - \underbrace{\frac{1}{\omega'+\omega}\{\alpha' \sin(\omega'+\omega) T_m + \beta' \cos(\omega'+\omega) T_m - \beta'\}}_{\text{Error component A1}} - \underbrace{\frac{1}{2\omega}\{\alpha \sin 2\omega T_m + \beta \cos 2\omega T_m - \beta\}}_{\text{Error component A2}} + \underbrace{\frac{1}{\omega'-\omega}\{\alpha' \sin(\omega'-\omega) T_m + \beta' \cos(\omega'-\omega) T_m - \beta'\}}_{\text{Error component A3}}]$$

A portion underlined by the first solid line in this equation is defined as a required component. A portion underlined by the first dotted line is defined as error component A1, a portion underlined by the second solid line is defined as error component A2, and a portion underlined by the second dotted line is defined as error component A3. In order to set all error components A1 to A3 to 0, measurement time $t_m$ may be set so as to satisfy the following equation, with $n_0$, $n_1$, and $n_2$ being set to arbitrary positive integers (natural numbers).

[Math. 12]

$$T_m = \frac{n_0}{\omega'+\omega}\pi = \frac{n_1}{2\omega}\pi = \frac{n_2}{\omega'-\omega}\pi$$

Figure 13:
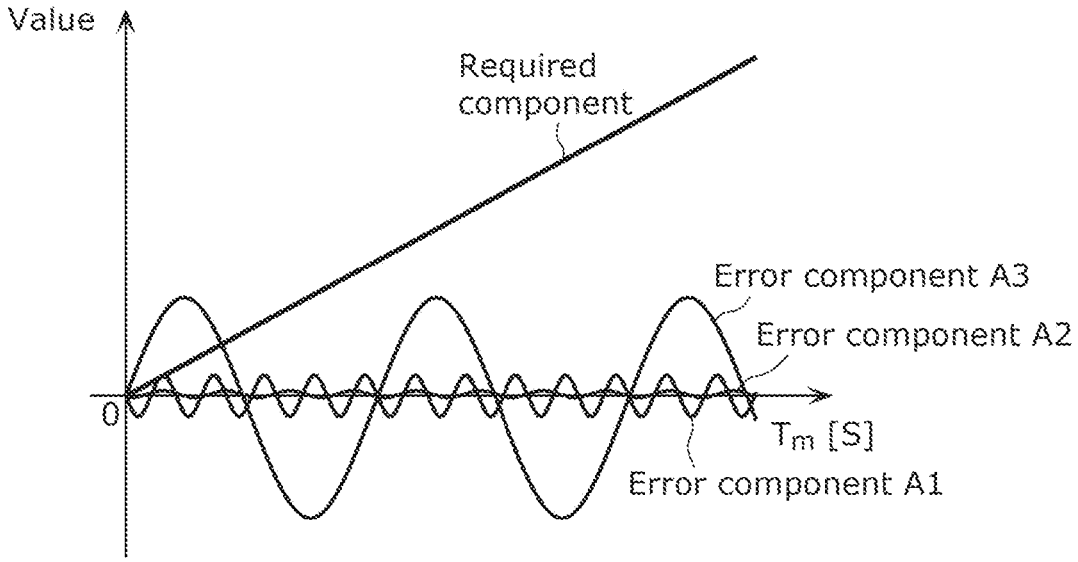
FIG. 13 is a second diagram showing an example of a relationship between a value of a required component, values of error components, and a measurement time.

However, measurement time $t_m$ that satisfies this equation is a relatively long time. Here, the value of the required component and the values of error components A1 to A3 vary as shown in FIG. 13. FIG. 13 is a diagram showing an example of a relationship between the value of the required component, the values of error components A1 to A3, and measurement time $T_m$. As shown in FIG. 13, it can be seen that, among error components A1 to A3, the influence of error component A3 is dominant. The condition for simultaneously measuring two frequencies is set as follows: $|\omega+\omega'|>2|\omega-\omega'|$. Specifically, when the sum of frequencies that are simultaneously measured is greater than twice the difference between the frequencies that are simultaneously measured, under this condition, $\omega'-\omega<2\omega<\omega'+\omega$ is obtained, and thus error component A3 is dominant.

Parameter B can be developed and rearranged as follows in the same manner as parameter A.

[Math. 13]

$$B = \frac{1}{2}[\underbrace{\beta T_m}_{\text{Required component}} + \underbrace{\frac{1}{\omega'+\omega}\{\beta' \sin(\omega'+\omega) T_m - \alpha' \cos(\omega'+\omega) T_m + \alpha'\}}_{\text{Error component B1}} + \underbrace{\frac{1}{2\omega}\{\beta \sin 2\omega T_m + \alpha \cos 2\omega T_m + \alpha\}}_{\text{Error component B2}} + \underbrace{\frac{1}{\omega'-\omega}\{\beta' \sin(\omega'-\omega) T_m - \alpha' \cos(\omega'-\omega) T_m + \alpha'\}}_{\text{Error component B3}}]$$

Although not shown in the diagrams, error components B1 to B3 exhibit the same behaviors as those of error components A1 to A3. That is, among error components B1 to B3, the influence of error component B3 is dominant.

In order to set error components A3 and B3 to 0, measurement time $t_m$ may be set so as to satisfy the following equation, where n is an arbitrary positive integer.

[Math. 14]

$$T_m = \frac{2n}{\omega'-\omega}\pi$$

Because $\omega=2\pi f$, difference $f'-f$ between frequencies at which transfer functions are simultaneously measured is set to be constant, and measurement time $t_m=n/(f'-f)$ is set (or in other words, measurement time $t_m$ is set to a time obtained by dividing natural number n by the frequency difference). It is thereby possible to both shorten the total measurement time and reduce errors. For example, when the difference between frequencies at which transfer functions are simultaneously measured is 50 Hz, measurer 17 sets the measurement time to $n\times(1/50)=n\times 20$ ms. It is thereby possible to both shorten the total measurement time and reduce errors.

Figure 14:
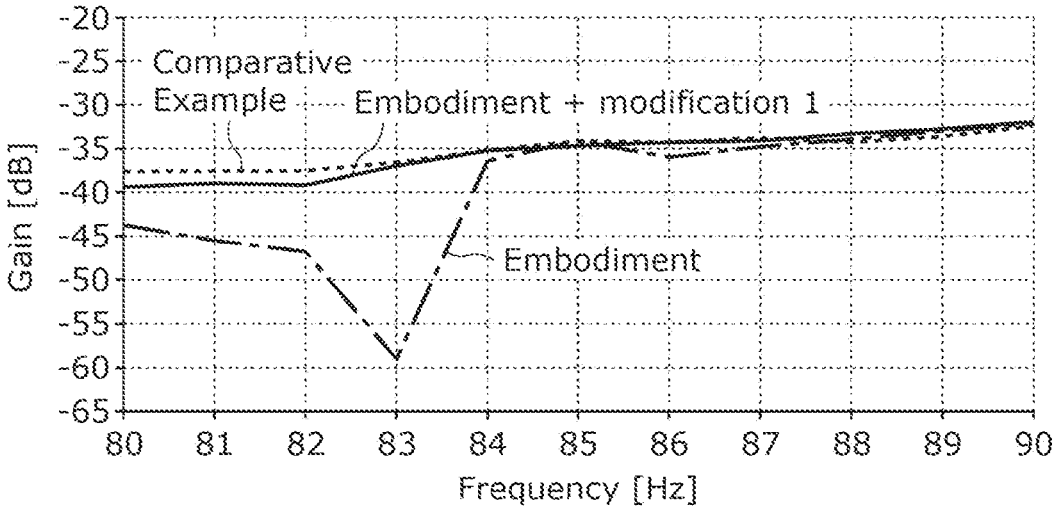
FIG. 14 is a diagram showing the results of transfer function gain measurement when modification 1 is applied to the measuring method according to the embodiment.

Hereinafter, transfer functions measured by using the measuring method to which modification 1 described above is applied will be described specifically. FIG. 14 is a diagram showing the results of transfer function gain measurement. A dotted line shown in FIG. 14 indicates a transfer function gain of a sound with a frequency of 80 Hz to 90 Hz measured by using the method according to the comparative example. A sold line shown in FIG. 14 indicates the transfer function gain when $T_m$=140 ms is set (or in other words, when n=7 is set in the equation given above) by applying modification 1 to the method according to the embodiment (simultaneously measuring a transfer function of a sound with a frequency of 80 Hz to 90 Hz and a transfer function of a sound with a frequency of 130 Hz to 140 Hz). A chain line shown in FIG. 14 indicates the transfer function gain when $t_m$=130 ms is set without applying modification 1 to the method according to the embodiment.

Figure 15:
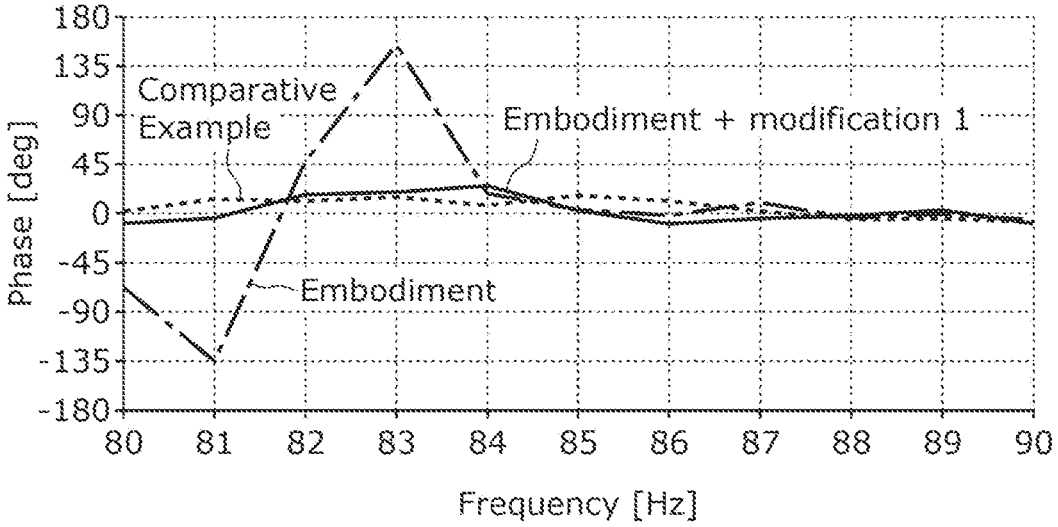
FIG. 15 is a diagram showing the results of transfer function phase measurement when modification 1 is applied to the measuring method according to the embodiment.

FIG. 15 is a diagram showing the results of transfer function phase measurement. A dotted line shown in FIG. 15 indicates a transfer function phase of a sound with a frequency of 80 Hz to 90 Hz measured by using the method according to the comparative example. A solid line shown in FIG. 15 indicates the transfer function phase when $T_m$=140 ms is set by applying modification 1 to the method according to the embodiment. A chain line shown in FIG. 15 indicates the transfer function phase when $t_m$=130 ms is set without applying modification 1 to the method according to the embodiment.

As shown in FIGS. 14 and 15, the transfer functions measured by using the method according to the embodiment to which modification 1 is applied can be approximated to the transfer functions measured by using the method according to the comparative example. That is, by applying modification 1, it is possible to both shorten the total measurement time and reduce errors.

[Modification 2]

In order to further reduce errors, it is necessary to give consideration to distortion components of loudspeakers SP1 to SP4. For example, when loudspeaker SP1 outputs a sound with a frequency of 30 Hz, a sound with a frequency of 60 Hz that corresponds to a second-order distortion component, a sound with a frequency of 90 Hz that corresponds to a third-order distortion component, and the like are also output. In the method according to the embodiment, distortion components are also simultaneously output from the plurality of loudspeakers SP1 to SP4 when sounds that have mutually different frequencies are simultaneously output from the plurality of loudspeakers SP1 to SP4, which causes errors.

Figure 16:
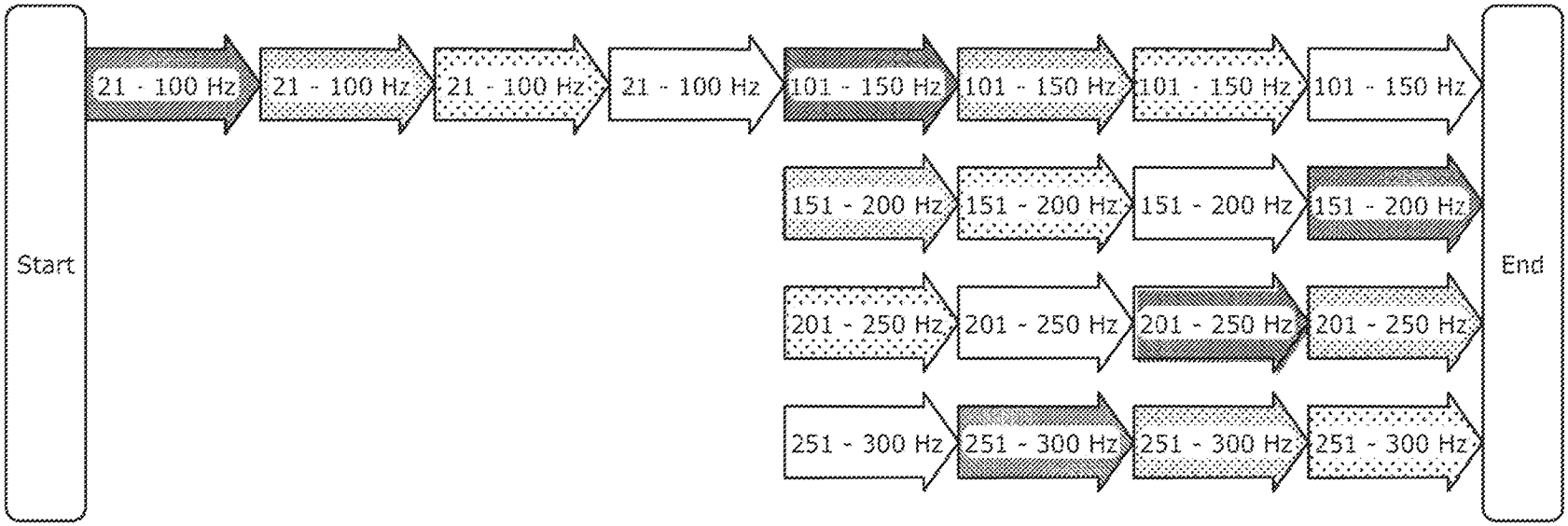
FIG. 16 is a diagram showing an overall procedure of the measuring method according to the embodiment to which modification 2 is applied.

To address this, measurer 17 may be configured to execute the method according to the comparative example (outputting a sound from only one loudspeaker) when the measurement target frequency belongs to a frequency band in which the influence of distortion components is large, and execute the method according to the embodiment when the measurement target frequency belongs to a frequency band in which the influence of distortion components is small. For example, in the case where it is necessary to reduce the margin of error to 5% or less, when the difference between the sound pressure of the measurement target signal and the sound pressure of the distortion component is 26 dB or more, measurer 17 executes the method according to the embodiment. As described above, measurer 17 may perform switching between the method according to the comparative example and the method according to the embodiment. FIG. 16 is a diagram showing an overall procedure of the method according to the embodiment to which modification 2 is applied. As in FIGS. 6 and 7, the colors (the concentrations of hatching) of the arrows shown in FIG. 16 indicate different loudspeakers.

In the example shown in FIG. 16, when the measurement target frequency is less than a threshold value (for example, 100 Hz), the number of loudspeakers that simultaneously output sounds is limited to one, and each of four loudspeakers SP1 to SP4 sequentially outputs a sound. When the measurement target frequency is greater than or equal to the threshold value, four loudspeakers SP1 to SP4 simultaneously output sounds in parallel.

Figure 17:
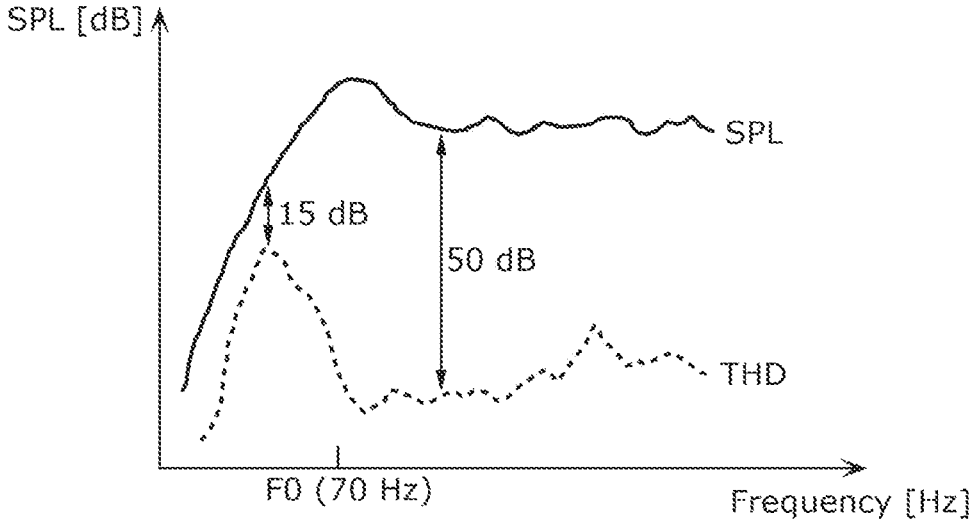
FIG. 17 is a diagram showing an example of frequency characteristics of a door loudspeaker.

The threshold value is set to, for example, the lowest resonant frequency of loudspeakers SP1 to SP4. In the case where active noise reduction device 10 is incorporated in automobile 50, as loudspeakers SP1 to SP4, for example, door loudspeakers with a loudspeaker aperture of 16 cm are used. FIG. 17 is a diagram showing an example of frequency characteristics of a door loudspeaker, and mainly shows the frequency characteristics of sound pressure SPL (Sound Pressure Level) of a sound output from the door loudspeaker and the frequency characteristics of total harmonic distortion THD. Here, total harmonic distortion=second-order distortion+ third-order distortion+ . . . .

Generally speaking, a door loudspeaker has lowest resonant frequency F0 of about 70 Hz to 90 Hz, and total harmonic distortion THD is relatively large at a frequency less than or equal to lowest resonant frequency F0. As described above, in order to reduce the margin of error to 5% or less, or in other words, in order to set the difference between the sound pressure of the measurement target signal and the sound pressure of the distortion component to be 26 dB or more, it is appropriate to set the value of F0 as the threshold value.

In the case where loudspeakers SP1 to SP4 have different lowest resonant frequencies, for example, the largest value of the lowest resonant frequencies is used. It is expected that the distortion components increase in a frequency band less than the lowest resonant frequency. Accordingly, by using the lowest resonant frequency as the threshold value, it is possible to shorten the total measurement time while suppressing the influence of the distortion components. The threshold value may be determined empirically and experimentally, and the use of the lowest resonant frequency of loudspeakers SP1 to SP4 as the threshold value is not a requirement.

[Modification 3]

When measuring a transfer function of a sound with a certain frequency by using the method according to the embodiment, as another method for reducing the influence of sounds with other frequencies that are output simultaneously with the sound with a certain frequency, a Hanning window may be applied to each of the first signal and the second signal. By applying a Hanning window as described above, it is expected that the influence of sounds with other frequencies can be further reduced.

[Variations]

The method according to the embodiment is executed by active noise reduction device 10 (measurer 17), but may be executed by a device other than active noise reduction device 10. The method according to the embodiment may be executed by, for example, a dedicated device for transfer function measurement or a personal computer.

Space 56 in automobile 50 is used as the target space for transfer function measurement, but a space other than space 56 may be used. The application of the measured transfer functions is not particularly limited, either. The measured transfer functions may be used in applications other than active noise reduction device 10.

Also, a combination of two or more of modifications 1 to 3 described above may be applied to the method according to the embodiment.

[Conclusion]

As described above, the transfer function measuring method includes: outputting step S23 of outputting a first signal to each of a plurality of loudspeakers SP1 to SP4 to cause the plurality of loudspeakers SP1 to SP4 to simultaneously output sounds with mutually different frequencies; acquiring step S25 of acquiring second signals output from microphone M1 as a result of acquiring the sounds with mutually different frequencies; and calculating step S26 of calculating a transfer function of each of the sounds with mutually different frequencies based on the first signal and the second signals.

With the transfer function measuring method as described above, it is possible to shorten the total measurement time as compared with the measuring method that causes the plurality of loudspeakers SP1 to SP4 to serially output sounds.

Also, for example, in calculating step S26, a transfer function of each of the sounds with mutually different frequencies may be calculated based on parameter C obtained by integrating a first function that is based on the first signal and uses time as a variable, and parameters A and B that are obtained by time-integrating second functions that are based on the second signals and use time as a variable, and measurement time $t_m$ that corresponds to an integration interval of the first function and an integration interval of each of the second functions may be set based on a frequency difference between the sounds with mutually different frequencies. Parameter C is an example of a first parameter, and parameters A and B are an example of a second parameter.

With the transfer function measuring method as described above, by setting measurement time $t_m$ to an appropriate value, it is possible to both shorten the total measurement time and reduce errors.

Also, for example, in calculating step S26, measurement time $t_m$ may be set to a time obtained by dividing natural number n by the frequency difference.

With the transfer function measuring method as described above, it is possible to both shorten the total measurement time and reduce errors.

Also, for example, the transfer function measuring method may further include a first measurement step of measuring the transfer function by limiting the loudspeakers that simultaneously output the sounds to one of the plurality of loudspeakers SP1 to SP4, and switching may be performed between the first measurement step and a second measurement step that includes outputting step S23, acquiring step S25, and calculating step S26 according to the measurement target frequency.

With the transfer function measuring method as described above, when the measurement target frequency is a frequency at which an error is likely to occur, the first measurement step is executed instead of the second measurement step. In this way, it is possible to reduce errors.

Also, for example, in the transfer function measuring method, when the measurement target frequency is less than the lowest resonant frequency of one of the plurality of loudspeakers SP1 to SP4, the first measurement step is executed. When the measurement target frequency is greater than or equal to the lowest resonant frequency of one of the plurality of loudspeakers SP1 to SP4, the second measurement step is executed.

With the transfer function measuring method as described above, when the measurement target frequency is less than the lowest resonant frequency of one of the plurality of loudspeakers SP1 to SP4, the first measurement step is executed instead of the second measurement step. In this way, it is possible to reduce errors.

Also, for example, in calculating step S26, a transfer function of each of the sounds with mutually different frequencies is calculated based on parameter C obtained by integrating a first function that is based on the first signal and uses time as a variable, and parameters A and B that are obtained by time-integrating second functions that are based on the second signals and use time as a variable, and a measurement time that corresponds to an integration interval of the first function and an integration interval of each of the second functions are set based on a frequency difference between the sounds with mutually different frequencies. The transfer function measuring method may further include a first measurement step of measuring the transfer function by limiting the loudspeakers that simultaneously output the sounds to one of the plurality of loudspeakers SP1 to SP4, and switching may be performed between the first measurement step and a second measurement step that includes outputting step S23, acquiring step S25, and calculating step S26.

With the transfer function measuring method as described above, it is possible to both shorten the total measurement time and reduce errors.

Also, for example, a plurality of loudspeakers SP1 to SP4 and a plurality of microphones M1 to M4 are installed in space 56 in automobile 50.

With the transfer function measuring method as described above, it is possible to shorten the total measurement time required to perform transfer function measurement in space 56 in automobile 50.

Also, for example, the transfer function measuring method is executed by active noise reduction device 10 that reduces noise in space 56.

As described above, the transfer function measuring method can be implemented by active noise reduction device 10.

Also, for example, active noise reduction device 10 includes a normal operation mode for reducing noise in the space and a measurement mode for executing the transfer function measuring method, and transitions to the measurement mode upon acquiring a mode transition instruction from information terminal device 60. The normal operation mode is an example of a first operation mode, and the measurement mode is an example of a second operation mode.

As described above, the transfer function measuring method can be implemented in response to transition of active noise reduction device 10 to the operation mode.

Also, active noise reduction device 10 includes: reference signal input terminal 11*a* to which a reference signal that has a correlation with noise is input; criterion signal generator 12 that generates a criterion signal with a frequency identified based on the input reference signal; adaptive filter unit 13 that generates a cancelling signal by applying an adaptive filter to the generated criterion signal, the cancelling signal being used to output a cancelling sound for noise reduction; cancelling signal output terminal 11*c* that outputs the generated cancelling signal to a loudspeaker; error signal input terminal 11*b* to which an error signal is input from microphone M1, the error signal corresponding to a residual sound generated through interference between the cancelling sound and the noise; corrector 14 that generates a corrected criterion signal by applying, to the criterion signal, simulated transfer characteristics obtained by simulating transfer characteristics from a position of loudspeaker SP1 to a position of microphone M1; filter coefficient updater 15 that sequentially updates a coefficient of the adaptive filter by using the error signal and the generated corrected criterion signal; and measurer 17. Measurer 17 performs: outputting a first signal to each of a plurality of loudspeakers SP1 to SP4 including loudspeaker SP1 to cause the plurality of loudspeakers SP1 to SP4 to simultaneously output sounds with mutually different frequencies; acquiring second signals output from microphone M1 as a result of acquiring the sounds with mutually different frequencies; and calculating a transfer function of each of the sounds with mutually different frequencies based on the first signal and the second signals. Reference signal input terminal 11*a* is an example of a reference signal inputter, cancelling signal output terminal 11*c* is an example of a cancelling signal outputter, and error signal input terminal 11*b* is an example of an error signal inputter.

With the transfer function measuring method executed by active noise reduction device 10 configured as described above, it is possible to shorten the total measurement time required to perform transfer function measurement as compared with the measuring method that causes the plurality of loudspeakers SP1 to SP4 to serially output sounds.

OTHER EMBODIMENTS

The embodiment has been described above, but the present disclosure is not limited to the embodiment given above.

The active noise reduction device according to the embodiment given above may be incorporated in a vehicle other than an automobile. The vehicle may be, for example, an aircraft or a vessel. Also, the present disclosure may be implemented as a vehicle other than an automobile as described above.

Also, the configuration of the active noise reduction device according to the embodiment given above is an example. For example, the active noise reduction device may include structural elements such as a D/A converter, a filter, a power amplifier, and an A/D converter.

Also, the processing performed by the active noise reduction device according to the embodiment given above is an example. For example, a portion of the digital signal processing described in the embodiment given above may be implemented by using analog signal processing.

Also, for example, in the embodiment given above, the processing performed by a specific processor may be performed by another processor. Also, the order in which a plurality of processing operations are performed may be changed, and a plurality of processing operations may be performed in parallel.

Also, in the embodiment given above, the structural elements may be implemented by executing a software program suitable for the structural elements. The structural elements may be implemented by a program executor such as a CPU or a processor reading a software program recorded in a recording medium such a hard disk or a semiconductor memory and executing the software program.

Also, the structural elements may be implemented by using hardware. For example, the structural elements may be circuits (or integrated circuits). These circuits may constitute one circuit as a whole, or may be separate circuits. Also, each of these circuits may be a general-purpose circuit or a dedicated circuit.

Also, general and specific aspects of the present disclosure may be implemented by using a system, a device, a method, an integrated circuit, a computer program, or a non-transitory computer-readable recording medium such as a CD-ROM.

Alternatively, general and specific aspects of the present disclosure may be implemented by using any combination of systems, devices, methods, integrated circuits, computer programs, and non-transitory computer-readable recording media.

For example, the present disclosure may be implemented as a program for causing a computer or a DSP to execute the transfer function measuring method. Also, the present disclosure may be implemented as a non-transitory computer-readable recording medium in which the program is recorded. Also, the present disclosure may be implemented as a measuring system according to the embodiment given above.

The present disclosure also encompasses other embodiments obtained by making various modifications that can be conceived by a person having ordinary skill in the art to the above embodiment as well as embodiments implemented by any combination of the structural elements and the functions of the above embodiment without departing from the scope of the present disclosure.

While various embodiments have been described herein above, it is to be appreciated that various changes in form and detail may be made without departing from the spirit and scope of the present disclosure as presently or hereafter claimed.

Further Information about Technical Background to this Application

The disclosure of the following patent application including specification, drawings and claims are incorporated herein by reference in its entirety: Japanese Patent Application No. 2021-059996 filed on Mar. 31, 2021.

INDUSTRIAL APPLICABILITY

With the transfer function measuring method according to the present disclosure, it is possible to shorten the total measurement time. Transfer functions measured by using the method described above can be used in, for example, an active noise reduction device for reducing noise in an automobile cabin.

The invention claimed is:

1. A transfer function measuring method comprising:

outputting a first signal to each of a plurality of loudspeakers to cause the plurality of loudspeakers to simultaneously output sounds with mutually different frequencies;

acquiring second signals output from a microphone as a result of acquiring the sounds with the mutually different frequencies; and calculating a transfer function of each of the sounds with the mutually different frequencies based on the first signal and the second signals.

2. The transfer function measuring method according to claim 1, wherein, in the calculating, the transfer function of each of the sounds with the mutually different frequencies is calculated based on a first parameter and second parameters, the first parameter being obtained by integrating a first function that is based on the first signal and uses time as a variable, and the second parameters being obtained by time-integrating second functions that are based on the second signals and use time as a variable; and a measurement time that corresponds to an integration interval of the first function and an integration interval of each of the second functions is set based on a frequency difference between the sounds with the mutually different frequencies.

3. The transfer function measuring method according to claim 2, wherein, in the calculating, the measurement time is set to a time obtained by dividing natural number n by the frequency difference.

4. The transfer function measuring method according to claim 1, further comprising:

a first measurement of measuring the transfer function n by limiting the plurality of loudspeakers that simultaneously output the sounds to one of the plurality of loudspeakers, wherein switching is performed between the first measurement and a second measurement that includes the outputting, the acquiring, and the calculating according to a measurement target frequency.

5. The transfer function measuring method according to claim 4, further comprising:

executing the first measurement when the measurement target frequency is less than a lowest resonant frequency of the one of the plurality of loudspeakers; and executing the second measurement when the measurement target frequency is greater than or equal to the lowest resonant frequency of the one of the plurality of loudspeakers.

6. The transfer function measuring method according to claim 1, wherein, in the calculating, the transfer function of each of the sounds with the mutually different frequencies is calculated based on a first parameter and second parameters, the first parameter being obtained by integrating a first function that is based on the first signal and uses time as a variable, and the second parameters being obtained by time-integrating second functions that are based on the second signals and use time as a variable; and a measurement time that corresponds to an integration interval of the first function and an integration interval of each of the second functions is set based on a frequency difference between the sounds with the mutually different frequencies, the transfer function measuring method further includes a first measurement of measuring the transfer function by limiting the plurality of loudspeakers that simultaneously output the sounds to one of the plurality of loudspeakers, and switching is performed between the first measurement and a second measurement that includes the outputting, the acquiring, and the calculating.

7. The transfer function measuring method according to claim 1, wherein the plurality of loudspeakers and the microphone are provided in a space within an automobile.

8. The transfer function measuring method according to claim 7, wherein the transfer function measuring method is executed by an active noise reduction device that reduces noise in the space.

9. The transfer function measuring method according to claim 8, wherein the active noise reduction device has a first operation mode for reducing the noise in the space and a second operation mode for executing the transfer function measuring method, and the active noise reduction device transitions to the second operation mode by acquiring a mode transition instruction from an information terminal device.

10. An active noise reduction device comprising:

a reference signal inputter to which a reference signal that has a correlation with noise is input;

a criterion signal generator that generates a criterion signal with a frequency identified based on the reference signal input;

an adaptive filter unit that generates a cancelling signal by applying an adaptive filter to the criterion signal generated, the cancelling signal being used to output a cancelling sound for reducing the noise;

a cancelling signal outputter that outputs the cancelling signal generated to a loudspeaker;

an error signal inputter to which an error signal is input from a microphone, the error signal corresponding to a residual sound generated through interference between the cancelling sound and the noise;

a corrector that generates a corrected criterion signal by applying, to the criterion signal, a simulated transfer function obtained by simulating a transfer function from a position of the loudspeaker to a position of the microphone;

a filter coefficient updater that sequentially updates a coefficient of the adaptive filter by using the error signal and the corrected criterion signal generated; and a measurer, wherein the measurer performs:

outputting a first signal to each of a plurality of loudspeakers including the loudspeaker to cause the plurality of loudspeakers to simultaneously output sounds with mutually different frequencies;

acquiring second signals output from the microphone as a result of acquiring the sounds with the mutually different frequencies; and calculating a transfer function of each of the sounds with the mutually different frequencies based on the first signal and the second signals.

* * * * *